US009492761B2

(12) United States Patent
Chao

(10) Patent No.: US 9,492,761 B2
(45) Date of Patent: Nov. 15, 2016

(54) MODEL LOCOMOTIVE WITH VAPOR-SMOKING AND FURNACE-FIRING-AND-LIGHTING EFFECTS

(71) Applicant: Shih-Ming Chao, Kaohsiung (TW)

(72) Inventor: Shih-Ming Chao, Kaohsiung (TW)

( * ) Notice: Subject to any disclaimer, the term of this patent is extended or adjusted under 35 U.S.C. 154(b) by 0 days.

(21) Appl. No.: 14/555,583

(22) Filed: Nov. 27, 2014

(65) Prior Publication Data

US 2016/0151718 A1 Jun. 2, 2016

(51) Int. Cl.
*A63H 19/14* (2006.01)

(52) U.S. Cl.
CPC ..... *A63H 19/14* (2013.01)

(58) Field of Classification Search
CPC ..... A63H 19/14; A63H 19/02; A63H 1/24
See application file for complete search history.

(56) References Cited

U.S. PATENT DOCUMENTS 2,461,664 A * 2/1949 Smith ..... A63H 19/14 105/49
2,520,916 A * 9/1950 Dasenbrock ..... A63H 19/14 446/25
4,374,038 A * 2/1983 Tamura ..... A63H 19/14 446/24
8,154,227 B1 * 4/2012 Young ..... A63H 19/24 318/255
2012/0094570 A1 * 4/2012 Mosher ..... A63H 19/14 446/25

* cited by examiner

*Primary Examiner* — Melba Bumgarner
*Assistant Examiner* — Amir Klayman

(57) ABSTRACT

A model locomotive with vapor-smoking and furnace-firing-and-lighting effects comprises an outer body; a hollow body installed within the outer body for installing liquid of specific volume; a funnel smoking tube installed at a front wall of the inner body; a steam whistle smoking tube, a safety valve smoking tube and a generator smoking tube installed at an upper wall of the inner body; a wind inlet tube for a blower installed at a rear wall of the inner body; a vapor generator, an air-exhausting and water-draining tube for a cylinder, and a water level switch being installed at a lower wall of the inner body; and a plurality of transparent smoking tube installed at a front wall and a rear wall of the inner body for viewing an interior of the inner body; a plurality of lighting elements being installed at the interior of the inner body, an outer side of the rear wall of the inner body and an interior of an opening of a combustion chamber.

4 Claims, 1 Drawing Sheet

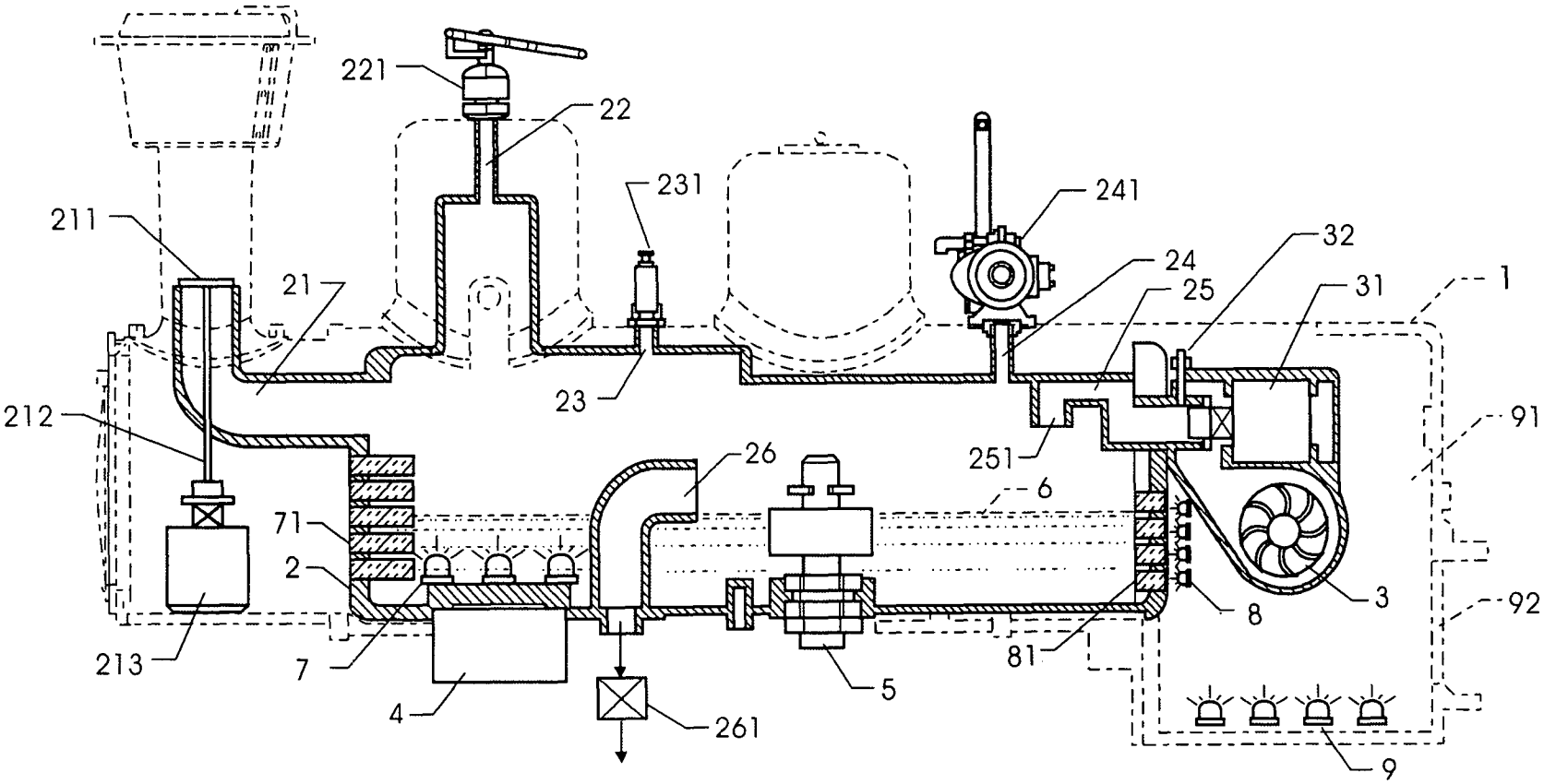
1
91
92
9
3
8
31
32
24
25
241
251
6
81
5
26
261
231
23
22
221
21
211
212
213
71
2
7
4

MODEL LOCOMOTIVE WITH VAPOR-SMOKING AND FURNACE-FIRING-AND-LIGHTING EFFECTS

FIELD OF THE INVENTION

The present invention relates to model locomotive, and in particular to a model locomotive with vapor-smoking and furnace-firing-and-lighting effects, in that by the vapor generator and blower installed within the inner body of the locomotive, the inner body will generate smoke continuously and the pressure will be accumulated. Furthermore, a plurality of lighting elements installed at a front wall and a rear wall of the inner body for viewing an interior of the inner body and a plurality of lighting elements being installed at the interior of the inner body, an outer side of the rear wall of the inner body and an interior of an opening of a combustion chamber cause that the inner body will have the effects of firing and lighting. When the control valves installed at the smoking tubes of the inner body synchronously and rapidly open and close the wind electromagnetic switch installed in the wind tube between the inner body and the blower, different smoking tubes will smoke rapidly and synchronously; and the plurality of lighting elements installed at the interior of the inner body, an outer side of the rear wall of the inner body and an interior of an opening of a combustion chamber flash, the model locomotive will present visual and hearing effects of smoking, and effects of firing and lighting in stopping or running.

BACKGROUND OF THE INVENTION

Model trains may be static and dynamic. A static model locomotive is used for decoration, while a dynamic model locomotive may present dynamic effects. Prior model locomotives cannot smoke, while for improving types, the model locomotives could smoke by adding oil therein. However, they cannot consist for a longer time and the smoke is harmful to human bodies. Therefore, they cannot generate virtual reality effects of smoking, firing and lighting and also cannot match the requirements of environment protection, sanitation and safety. Furthermore for known smoking effect presented on prior model locomotive, a fan is used to control the volume of smoking by wind pressure from the wind speed switch of the fan. However, the time different of the volume of the wind from the fan between the wind pressure accumulation and releasing, the smoking of the model locomotive can be reacted simultaneously so as to affect the virtual reality effect of the model locomotive and to cause the non-synchronization of the actions.

Furthermore for known model locomotives, they cannot provide the effects of firing and lighting so that the model locomotive cannot provide the visual and hearing effects of virtual reality.

Therefore, there is an eager demand for a novel model locomotive which can provide vapor-smoking and furnace-firing-and-lighting effects so as to increase the industrial value and the value for storage.

SUMMARY OF THE INVENTION

To improve above mentioned defects, the present invention provides a model locomotive with vapor-smoking and furnace-firing-and-lighting effects. The objects of the present invention are that: providing a model locomotive which present effects of synchronously smoking, firing and lighting as the locomotive stops or runs so as to increase the industrial value of the model locomotive and value in storage; providing a model locomotive which generating vapor smoking effect while it is harmless to human bodies and is safe and non-poisonous to environment; furthermore, providing a model locomotive which has the effect of firing and lighting in the inner body of the locomotive so as to increase the industrial value and the value in storage.

To achieve object, the present invention provides a model locomotive with vapor-smoking and furnace-firing-and-lighting effects comprising: an outer body; a hollow inner body installed within the outer body for installing liquid of specific volume (the liquid within the inner body is one of water, water liquid added with oil); a funnel smoking tube installed at a front wall of the inner body; a steam whistle smoking tube, a safety valve smoking tube and a generator smoking tube installed at an upper wall of the inner body; an opening of each smoking tube is installed with a control valve for controlling smoking; a wind inlet tube for a blower installed at a rear wall of the inner body; a section of the wind inlet tube between the inner body and the blower is installed with an electromagnetic switch for controlling volume of wind; a vapor generator, an air-exhausting and water-draining tube for a cylinder, and a water level switch being installed at a lower wall of the inner body; and a plurality of lighting elements installed at a front wall and a rear wall of the inner body for viewing an interior of the inner body; a plurality of lighting elements being installed at the interior of the inner body, an outer side of the rear wall of the inner body and an interior of an opening of a combustion chamber.

By the vapor generator and blower installed within the inner body, the inner body will generate smoke continuously and the pressure will be accumulated. When the control valves installed at the smoking tubes of the inner body with the synchronous and rapidly opening and closing action of the wind electromagnetic switch installed in the wind tube between the inner body and the blower, different smoking tubes will smoke rapidly and synchronously. As a result, the model locomotive will present visual and hearing effects of smoking when the locomotive stops or runs. Furthermore, a plurality of lighting elements installed at a front wall and a rear wall of the inner body for viewing an interior of the inner body and a plurality of lighting elements being installed at the interior of the inner body, an outer side of the rear wall of the inner body and an interior of an opening of a combustion chamber cause that the inner body will have the effects of firing and lighting.

BRIEF DESCRIPTION OF THE DRAWINGS

FIG. 1 shows a cross sectional view of the present invention.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIG. 1, the structure of the model locomotive according to the present invention is illustrated. The locomotive of the present invention includes the following elements.

An outer body 1 is included.

A hollow inner body 2 is installed within the outer body 1 for installing liquid of specific volume (such as water, water liquid added with oil, or other liquids without harmful liquid or vapor).

A funnel smoking tube 21 installed at a front wall of the inner body 2; an opening of the smoking tube 21 is installed with a controllable valve sheet 211 which is controlled by a driving rod 212. The movement of the driving rod 212 is controlled by an electromagnetic control valve 213. The electromagnetic control valve 213 is controlled by an external power source.

A steam whistle smoking tube 22, a safety valve smoking tube 23 and a generator smoking tube 24 are installed at an upper wall of the inner body 2. An opening of the steam whistle smoking tube 22 is installed with a controllable control valve 221 which is controlled by an external power source. An opening of the safety valve smoking tube 23 is installed with a safety release valve 231, in that when the pressure of the inner body 2 has achieved to a predetermined upper limit, the safety release valve 231 will actuate automatically. At an opening of the generator smoking tube 24 is installed with a control valve 241 which is controlled by an external power source (not shown).

A wind inlet tube 25 for a blower is installed at a rear wall of the inner body. An end of the wind inlet tube 25 extending out of the inner body 2 is installed with the blower 3. A section of the wind inlet tube 25 between the inner body 2 and the blower 3 is an electromagnetic switch 31 and an adjustable screw 32 for controlling volume of wind. The electromagnetic switch 31 and the adjustable screw 32 are acted rapidly and synchronously. The electromagnetic switch 31 is controlled by an external power source. An inner end of the wind inlet tube 25 extending inside the inner body 2 is a wind inlet opening 251 which faces downwards and is non-horizontal and waterproof.

A vapor generator 4, an air-exhausting and water-draining tube 26 for a cylinder, and a water level switch 5 are installed at a lower wall of the inner body 2. The vapor generator 4 generates vapor by oscillating water molecules so that liquid 6 within the inner body 2 generates non-poisonous safety smoke which is full of interior of the inner body 2. Furthermore by the wind pressure from the wind supplied from the blower 3, vapor is formed like draining water-vapor which is accumulated within the inner body 2 and has predetermined pressures. One end of the cylinder air-exhausting and water-draining tube 26 extends into the interior of the inner body 2 with a predetermined height and another end thereof is out of the inner body 2. As adding liquid 6 is over a level of an inner opening of the cylinder air-exhausting and water draining tube 26, surplus liquid will enters into the cylinder air-exhausting and water-draining tube 26 and then is drained out of the inner body 2. Meanwhile, as adding liquid is over a level of an outer opening of the cylinder air-exhausting and water-draining tube 26, it is controlled by a control valve 261 for controlling smoke of the cylinder air-exhausting and water-draining tube 26. The actuation of the control valve 261 is controlled by external power sources.

In practical usages, the actuations of the control valve 213, 221, 241 and 261 are synchronous or non-synchronous so as to control the smoking in different parts synchronously or non-synchronously. The external power sources serve to synchronously or non-synchronously control the actuation and timing of the various control valves with the moving speed of a model locomotive so as to have novel visual and hearing effects by rapidly synchronous smoking of the simulated vapors from the model locomotive.

Furthermore, the interior of the inner body 2 of the model locomotive 1 is installed with a plurality of lighting elements 7, and the front wall of the inner body 2 is installed with a plurality of transparent smoking tubes 71 for viewing the interior of the inner body 2. A rear wall of the inner body 2 is installed with a plurality of transparent smoking tubes 8 for viewing the interior of the inner body 2. An outer side of a rear end of each transparent smoking tubes 8 at the rear wall of the inner body 2 is installed with a plurality of lighting elements 8. An opening 92 of a combustion chamber 91 is installed with a plurality of lighting elements 9 for generating simulated fire within an interior of the combustion chamber. The lighting elements 7, 8 and 9 controllable by power sources so that as power is in an on state, the model locomotive may have effects of firing and lighting.

Therefore the model locomotive with vapor-smoking and furnace-firing-and-lighting effects of the present invention has the virtual reality effects of smoking, firing and lighting when the locomotive stops or runs. Thus, the industrial value and storage value of the model locomotive are increased greatly.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A model locomotive with vapor-smoking and furnace-firing-and-lighting effects comprising:

an outer body;

a hollow inner body installed within the outer body for installing liquid of specific volume; and the liquid within the inner body being one of water and water liquid added with oil;

a funnel smoking tube installed at a front wall of the inner body;

a steam whistle smoking tube, a safety valve smoking tube and a generator smoking tube installed at an upper wall of the inner body; a safety release valve being installed in an opening of the safety valve smoking tube, in that when the pressure of the inner body has achieved to a predetermined upper limit, the safety release valve will actuate automatically;

a blower (3) with a wind inlet tube (25) installed at a rear wall of the inner body; wherein an inner end of the wind inlet tube (251 extending inside the inner body (2) is a wind inlet opening (251) which faces downwards and is non-horizontal and waterproof; and another end of the wind inlet tube (25) extending out of the inner body is installed with the blower (3); wherein a section of the wind inlet tube (25) between the inner body (2) and the blower (3) is installed with an electromagnetic switch (31) and an adjustable screw (32) for controlling volume of wind; and the electromagnetic switch (31) and the adjustable screw (32) are acted rapidly and synchronously;

a vapor generator, an air-exhausting and water-draining tube, and a water level switch being installed at a lower wall of the inner body; and a plurality of transparent smoking tubes installed at a front wall and a rear wall of the inner body for viewing an interior of the inner body; a plurality of lighting elements being installed at the interior of the inner body, an outer side of the rear wall of the inner body and an interior of an opening (92) of a combustion chamber (91); the lighting elements (9) at the interior of the opening (92) of a combustion chamber (91) being used for generating simulated fire within an interior of the combustion chamber (91); and an opening of each smoking tube is installed with a control valve for controlling smoking.

2. The model locomotive with vapor-smoking and furnace-firing-and-lighting effects as claimed in claim 1, wherein one end of the cylinder air-exhausting and water-draining tube extends into the interior of the inner body with a predetermined height and another end thereof is out of the inner body.

3. The model locomotive with vapor-smoking and furnace-firing-and-lighting effects as claimed in claim 1, wherein the liquid within the inner body is one of water and water liquid added with oil.

4. The model locomotive with vapor-smoking and furnace-firing-and-lighting effects as claimed in claim 1, wherein the transparent smoking tubes are formed with transparent material and are fixed to or formed integral with the wall of the inner body.

* * * * *